United States Patent [19]

White

[11] 4,249,601

[45] Feb. 10, 1981

[54] HYDRAULIC RUNNING TOOL FOR LINER HANGERS

[76] Inventor: Pat M. White, 5325 Hendrix, Lewisville, Tex. 75056

[21] Appl. No.: 9,861

[22] Filed: Feb. 6, 1979

[51] Int. Cl.[3] ..... E21B 23/00

[52] U.S. Cl. ..... 166/208; 166/212

[58] Field of Search ..... 166/208, 212, 120, 124

[56] References Cited

U.S. PATENT DOCUMENTS

| | | | |
|---|---|---|---|
| 3,608,634 | 9/1971 | Cochran | 166/208 |
| 4,096,913 | 6/1978 | Kenneday et al. | 166/208 X |

*Primary Examiner*—William F. Pate, III

[57] ABSTRACT

The present invention discloses an apparatus for running and setting a liner hanger in a well bore casing. The usual liner hanger comprises two movable tubular members and a gripping means which is activated by relative movement of said members. The running and setting tool of this invention is connected to each of the tubular members of the hanger by selectively releasable means and includes a pressure responsive piston and cylinder assembly which transmits relative movement to the tubular members and thereby sets the gripping means. Coacting means on the running and setting tool and on the liner hanger prevents premature setting of the gripping means prior to piston and cylinder movement. After setting the hanger, the tool and its operating parts including the piston and cylinder assembly are removed from the well.

16 Claims, 9 Drawing Figures

HYDRAULIC RUNNING TOOL FOR LINER HANGERS

BACKGROUND OF THE INVENTION

1. Field of the Invention

The invention relates to an apparatus with retrievable setting means for running and setting a liner in a well bore casing.

2. Prior Art

The majority of prior art hydraulically set liner hangers have hydraulic setting mechanisms which are integral parts of the hanger assemblies and are left in the well following setting of the liner. The hydraulic setting mechanisms generally consist of piston-cylinder arrangements which, as part of the liner hanger, tend to restrict the I.D. of the well below the liner hanger. Moreover, since the setting mechanisms are integral parts of the liner hangers, they must remain in the well which greatly increases the cost of a liner hanger.

U.S. Pat. No. 4,096,913 discloses a running and setting tool in which its operating parts are retrievable. However, it provides both a hydraulic and mechanical setting means and therefore, requires the use of a drag block located below a J-slot assembly with the latter connected to the running tool by a shear pin. The function of the shear pin is to prevent any unintentional and premature setting of the liner hanger but because the drag block is in continuous contact with the casing as the tool is run into the hole, the frictional force created by this contact is transmitted directly to the shear pin which could cause the shear pin to sever while the tool is being lowered into the hole resulting in premature setting of the liner hanger. Additionally, drag forces created between the liner and liner hanger and the well bore and well bore casing is also transmitted directly to the shear pin which could similarly cause premature setting of the liner hanger.

Also, since both hydraulic and mechanical setting means are included on the running tool, the running tool is very complicated and expensive.

SUMMARY OF THE INVENTION

The present invention overcomes the disadvantages of prior art hydraulically set liner hangers by providing an improved hydraulically set liner hanger with retrievable hydraulic setting means in the running and setting tool which will not prematurely set in the casing regardless of whether the liner hanger is being lowered or raised in the hole. Additionally, the present invention is simpler and less expensive than prior art hydraulically set liner hangers with retrievable setting means.

One object of the invention is to provide an improved tool for running and setting a liner hanger in a well bore casing in which a hydraulic piston and cylinder assembly is incorporated as a part of said tool, whereby after the tool has been operated to set the hanger, said tool and its operating parts are retrievable.

Another object is to provide an improved running and setting tool for a liner hanger wherein premature actuation of its hydraulic piston and cylinder assembly is positively prevented to assure that there will be no premature setting of the liner hanger, thereby assuring proper location of the hanger within the well bore.

Still another object is to provide an improved running and setting tool of the character described which has a connection with the liner hanger through selectively releasable means and also wherein the hydraulic piston and cylinder assembly is prevented from operation by a second selectively releasable means, with the releasable means of said assembly being controlled by the fluid pressure applied thereto.

BRIEF DESCRIPTION OF THE DRAWINGS

FIG. 4B showing the lower portion of the running tool and the central section of the liner hanger; and FIG. 4C illustrating the lower portion of the liner hanger including its gripping means;

DESCRIPTION OF THE PREFERRED EMBODIMENT

Figure 1:
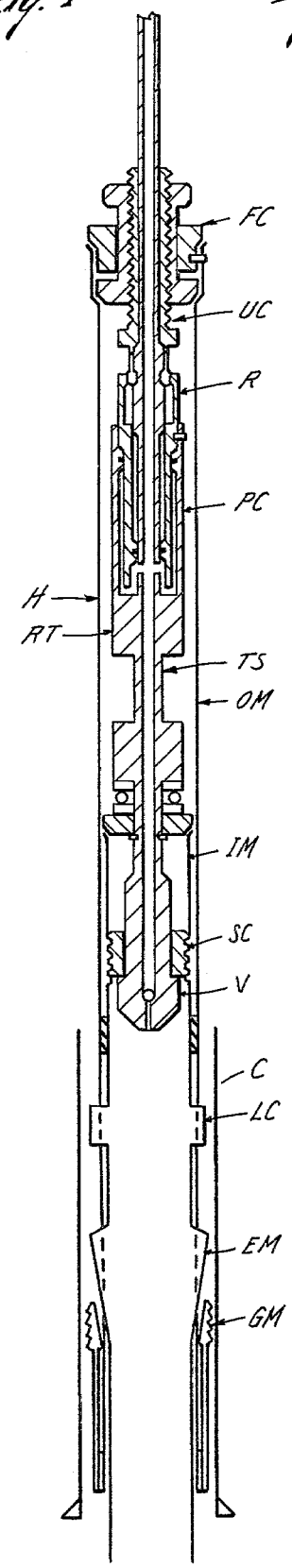
FIG. 1 is a longitudinal schematic view showing the hyraulically set liner hanger assembly in a well bore prior to the liner hanger being set in the casing.
Figure 2:
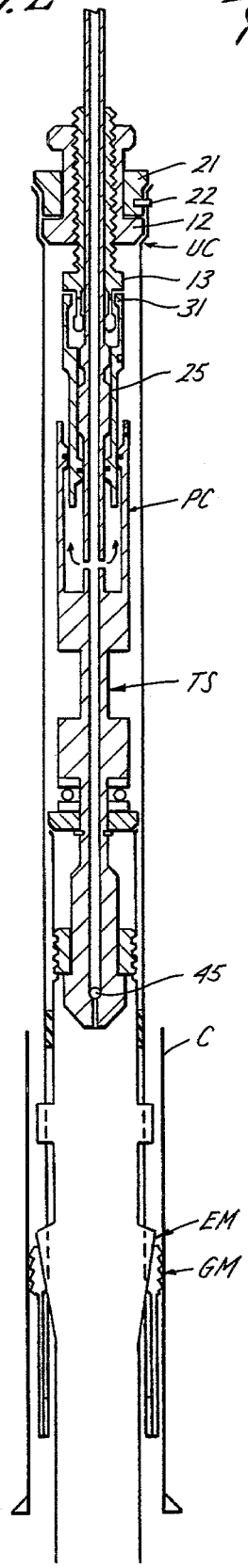
FIG. 2 is a similar schematic view, illustrating the liner hanger in a set position.
Figure 3:
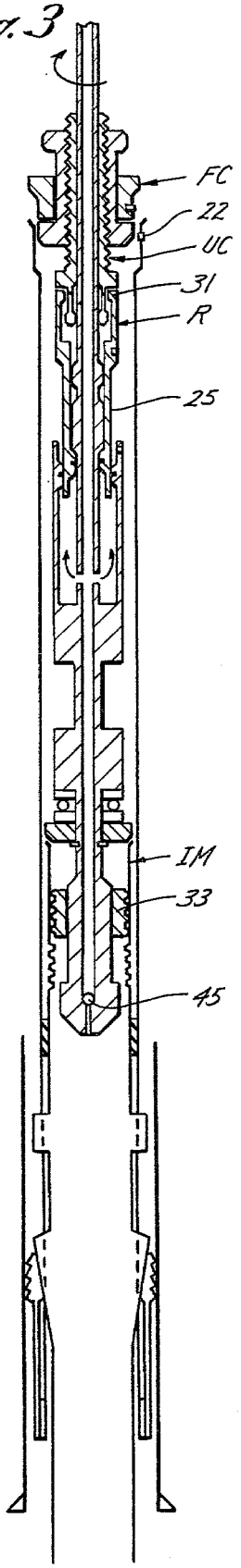
FIG. 3 is a similar schematic view, showing the running and setting tool disengaged from the liner hanger and capable of being removed from the well.

As shown in FIGS. 1, 2 and 3, the apparatus is comprised of a running and setting tool RT and a liner hanger H. The liner hanger H is generally comprised of outer tubular hanger member OM, inner tubular member IM, expander means EM, gripping means GM, and lower coacting means LC which prevents premature setting of the liner hanger H in casing C. Outer member OM and inner tubular member IM are longitudinally movable relative to each other and when so moved, will set the gripping means of the hanger.

In the drawings, the letter RT designates the running and setting tool of this invention. The tool is constructed to lower and set a liner hanger H.

The running and setting tool RT includes a main tubular support TS, first frangible connecting means FC attaching the tubular support TS with the outer hanger member OM, second connecting means SC attaching the tubular support TS with the inner tubular member IM, piston and cylinder assembly PC, upper coacting means UC which prevent premature setting of the liner hanger, and releasing mechanism R for releasing the piston and freeing the upper coacting means UC for movement independent of tubular support TS. Although not necessarily a part of the apparatus, a valve V is illustrated in FIGS. 1–3 and FIG. 4B and is utilized for sealing the interior bore of the tubular support TS during setting operations.

Figure 4A:
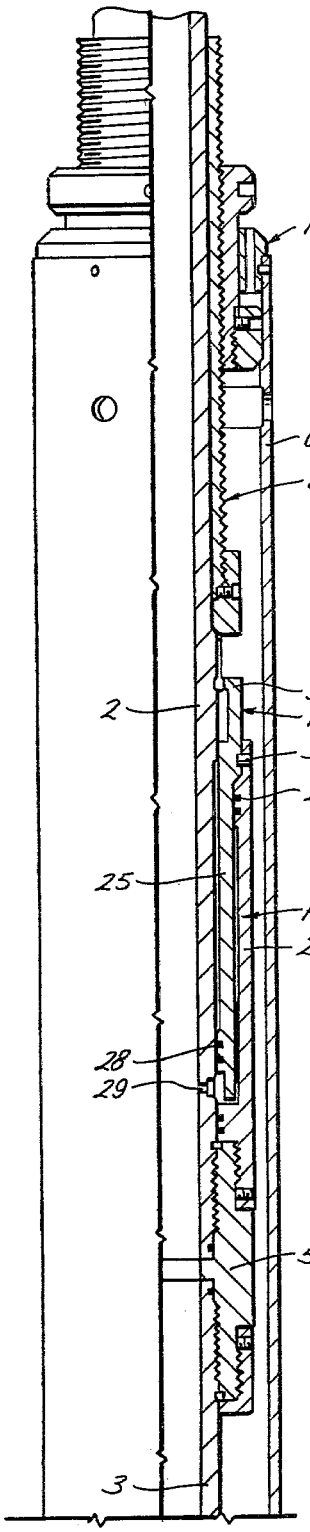
FIGS. 4A through 4C are longitudinal quarter sectional drawings illustrating the position of the respective parts of the running and setting tool and the liner hanger during running thereof into the well and prior to activation of the setting mechanism with FIG. 4A illustrating the upper portion of the running tool and the upper end of the liner hanger.
Figure 4B:
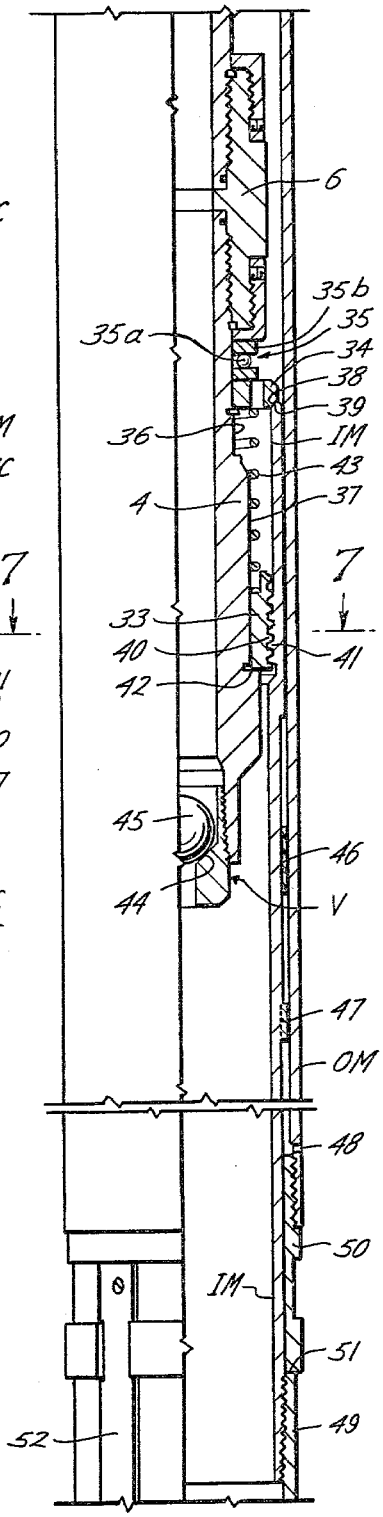
Figure 4C:
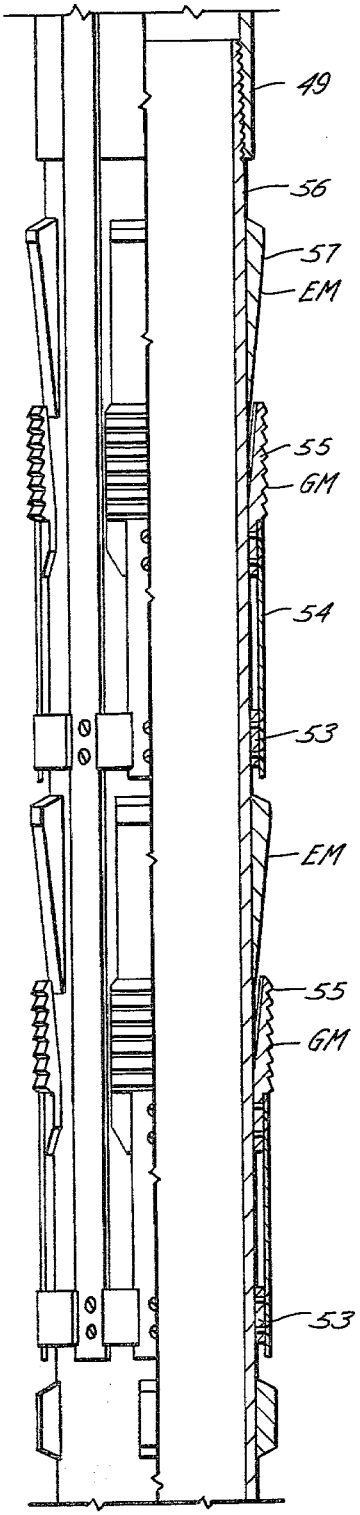

Referring now to FIGS. 4A, 4B, and 4C, the tubular support TS comprises an upper section 2, intermediate section 3, and lower section 4 which are connected to each other by the usual threaded couplings 5 and 6 with the couplings having the usual seal rings to prevent leakage at the joints. The upper section 2 is adapted at its top end for connection to well pipe (not shown) which extends to the top of the well.

The outer hanger member OM surrounds the upper section 2 and defines an annulus, in which is located the upper coacting means UC, first connecting means FC, piston and cylinder assembly PC, and releasing mechanism R for unlocking the piston and freeing upper coacting means UC for movement independent of tubular support TS.

Upper coacting means UC in combination with lower coacting means LC prevent premature setting of gripping means GM as running tool RT and hanger H is moved with a well bore by preventing longitudinal movement of inner tubular hanger member IM and attached expander means EM relative to outer tubular hanger member OM and attached gripping means GM. More specifically, upper coacting means UC prevents upward movement of outer member OM relative to tubular support TS and attached inner tubular member IM. Additionally, upper coacting means UC provides a means for transmitting movement generated by piston and cylinder assembly PC to outer member OM so as to activate gripping means GM, as will be hereinafter explained.

Figure 5:
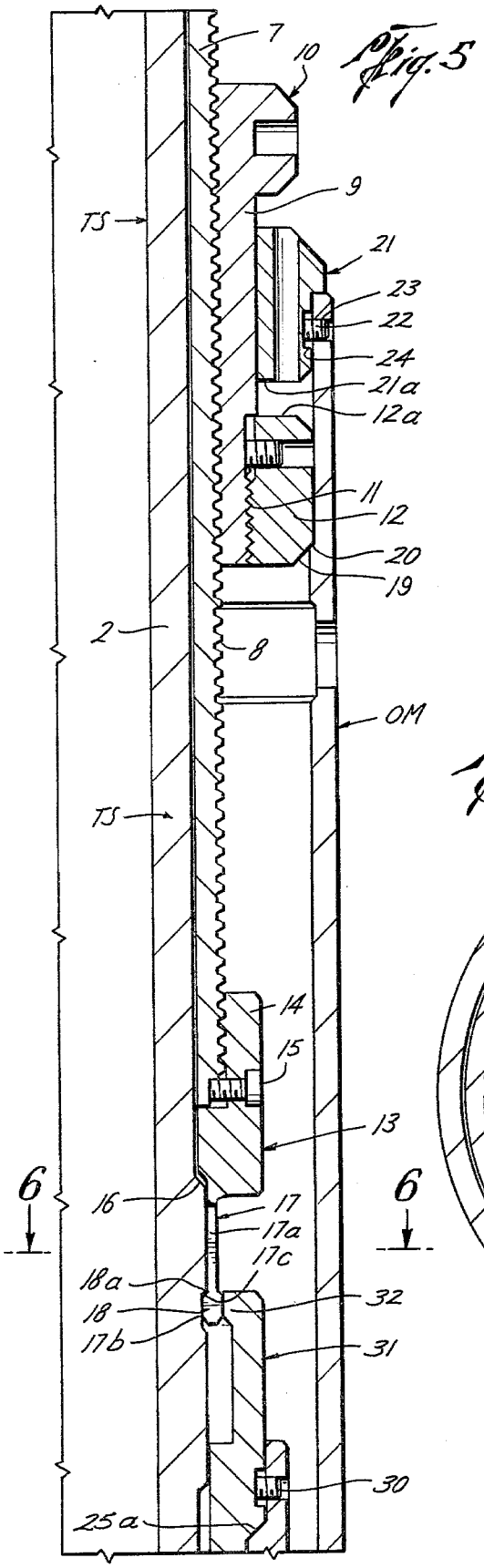
FIG. 5 is an enlarged partial longitudinal sectional view of the upper part of FIG. 4A.

As illustrated in FIG. 5, upper coacting means UC includes an elongated sleeve 7 having external threads 8, internally threaded collar 9 with flange element 10 at its top end and threads 11 at its lower external end, internally threaded support ring 12, and collet device generally indicated by numeral 13. Elongated sleeve 7, which is exterior of and slidable with upper housing 2, is connected to the interior of collar 9 by the external threads 8. Collar 9 is also attached by lower exterior threads 11 to the interior bore of support ring 12 and may be additionally affixed by a conventional retaining screw.

The uppermost portion of the collet device 13 comprises a collar 14 which is threaded onto the lower portion of the external threads 8 of elongated sleeve 7 and is further retained on said sleeve by the usual retaining screw 15. The unthreaded portion of the bore of the collar surrounds the upper section 2 of the support TS above an upwardly facing shoulder or abutment 16 and is slidable upwardly on the exterior of upper section 2. The bore of the collar has an internal annular shoulder which limits downward movement of the collet device on the support TS.

Figure 6:
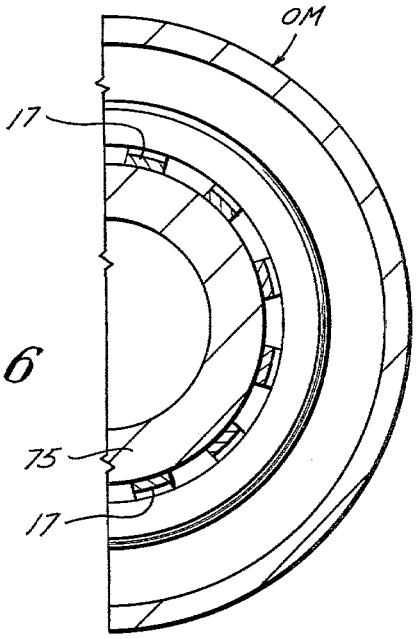
FIG. 6 is a cross-sectional view taken on the line 6—6 of FIG. 5.

Attached to the lower innermost portion of collar 14 of the collet device 12 are a plurality of downwardly extending latch or finger elements 17. As seen in FIG. 6, the elements are disposed circumferentially around the support TS. Each latch element is formed by a downwardly extending flexible shank **17*a* having an enlargement 17*b* at its lower end. Each enlargement is adapted to engage within an annular groove 18 in the external wall of the tubular support and the upper end 18*a* of said groove is inclined to form a force-bearing shoulder which an inclined complementary shoulder 17*c* on each latch element is adapted to engage. The inclined annular surface 18*a* and the inclined shoulders 17*c* of the latch elements are force-bearing shoulders since any relative upward force on the upper coacting means UC generated by the outer hanger member OM is transmitted to the support TS through these surfaces whenever they are engaged. When the latch elements are not engaged with the surface 18*a*, the upper coacting means UC is free to move upward relative to upper section 2** of the tubular support TS.

The lower exterior surface of support ring 12 has a downwardly facing beveled shoulder 19 which complements inwardly protruding upwardly facing shoulder 20 of outer hanger member OM. Shoulders 19 and 20 are also force-bearing shoulders since any relative upward force on outer member OM is transmitted to upper coacting means UC through these whenever said shoulders are in contact as illustrated in FIGS. 1, 2, 4A and 5. Therefore, whenever latch elements 17 are laterally held in the annular groove 18 and shoulders 19 and 20 are in contact, any upward force exerted on outer hanger member OM, such as an upward force created by drag of the liner hanger or liner with the well bore or well bore casing as the liner and liner hanger move downward in the well, is transmitted through the two sets of force bearing shoulders directly to tubular support TS. Most importantly, the upper force created by drag does not result in movement between outer hanger member OM and tubular support TS. The lengthy thread section of threads 8 on sleeve 7 allows support ring 12 and collar 9 to be properly positioned on the exterior of elongated sleeve 7 so that the latch elements 17 of the collet device 13 are engaged in groove or recess 18 contacting surface **18*a* at the same time that shoulder 19 of support ring 12 contacts shoulder 20**.

First connecting means FC includes an annular unthreaded member 21 located between flanged collar 9 and outer hanger member OM and above support ring 12. The upper exterior of collar 9 is slidable along the interior bore of annular member 21. Annular member 21 is affixed to outer member OM by a plurality of frangible shear pins 22 inserted through opening 23 within outer hanger member OM and secured within companion grove 24 within annular member 21. It should be noted that the vertical length of companion groove 24 is somewhat larger than the diameter of frangible shear pins 22 thereby allowing some longitudinal movement of annular member 21 along the interior bore of outer hanger member OM prior to the bottom wall of said groove contacting shear pins 22. Although a plurality of frangible shear pins 22 is illustrated in FIG. 4A, any number of shear pins can be used. Since first connecting means FC is not affixed to the upper coacting means UC, the upper coacting means UC can move longitudinally upward relative to the first connecting means FC until upper surface **12*a* of support ring 12 abuts lower surface 21*a* of annular member 21. Moreover, since first connecting means FC is not affixed to upper coacting means UC, any upward force on the outer body is transmitted through the two sets of force bearing shoulders to running and setting tool RT and is not transmitted to frangible shear pins 22** and the remainder of first connecting means FC.

Piston and cylinder assembly PC is generally located below upper preventing means UP and is in the annulus between the upper section of the tubular support TS and outer hanger member OM. Piston and cylinder assembly PC comprises piston element 25 and cylinder 26. The interior wall of cylinder 26 is formed by the exterior surface of the upper section 2 of the tubular support.

Piston element 25 is annular and is slidable within the cylinder with suitable seals 27 therebetween. Piston element is also sealed by seals 28 with the exterior of the tubular support. The surfaces of an inwardly extending abutment within the cylinder piston element 25 defines the pressure responsive area for the piston.

Communication between the interior of cylinder 26 and the interior of upper section of the tubular support is provided by a lateral port 29 in the support located at the lower end of the cylinder. The piston 25 and cylinder 26 are initially connected through a releasable connection such as a shear pin 30 which extends through the cylinder and into a recess in the exterior of the piston. Shearing of said pin releases the assembly for operation.

The releasing mechanism R for freeing the upper coacting means UC to move independently of tubular support TS is shown in FIG. 5. Shear pin 30 will prevent movement of piston element until sufficient pressure is exerted through port 29 to sever said shear pin. If desired, one or more shear pins may be employed. The uppermost end of piston element 28 has an upwardly projecting annular extension or sleeve 31 and an internal annular projection 32 is formed within the bore of said extension to project inwardly thereof. In the running position illustrated in FIGS. 4A and 5, the bore of the projection slidably engages the exterior of the enlargements **17*b* of the latch elements 17 and laterally urges said elements into the recess 18 so that the shoulder 17*b* of each element abuts the force bearing shoulder 18*a* of recess 18. Once shear pin is severed, upward movement of piston element 25 will slide the annular projection or sleeve along the exterior of the latch elements 17 until projection 32 is above elements 17 thereby freeing the elements to expand outwardly away from recess 18 and into the annulus exteriorly of upper section 2 of the tubular support. With the latch element 17 not being laterally held within the recess 18**, upper coacting means UC is free to move upward relative to the tubular support TS.

As has been explained, the tool includes the tubular support formed of the three interconnected sections 2, 3 and 4. The intermediate section functions as a spacer with the lower section being constructed to provide a releasable connection with the inner hanger member IM.

The second connecting means SC which releasably attaches the inner tubular member IM with the running tool RT includes the lower tubular section 4, floating nut 33, bearing plate 34, bearing assembly 35 and said inner tubular member IM. As previously mentioned, inner tubular member IM is one of the two tubular members comprising hanger H and is movable relative to outer hanger member OM. The exterior of the lower section is circular in cross-section at its upper portion as indicated at 36 but its lower portion is square in cross-section as indicated at 37 (see FIG. 7). The lowermost end of the section is internally threaded and has the valve seat V mounted therein.

The annular plate member 34 is mounted on the exterior of lower section 4 and is retained thereon between a retaining ring 39 below the plate and the bearing assembly 35 which surrounds the exterior of the section. The lower exterior surface of the bearing plate 34 has a downwardly facing beveled seating surface 38 which engages a complementing annular upwardly facing seat 39 at the top of the inner tubular member IM. Any downward force applied to the running and setting tool RT will be transmitted through the beveled seating surface 38 of plate 34 to the top of inner tubular member IM.

Bearing assembly 35 includes the usual plurality of bearings **35*a* between races 35*b* and is disposed between the bottom of coupling 6 and the top of bearing plate 34. By interposing the bearing 35 between the coupling 6 and the bearing plate 34, the tubular support TS may be rotated to uncouple the floating nut 33**, as will be explained, without imparting any rotational force to the bearing plate or to the inner hanger member IM.

Figure 7:
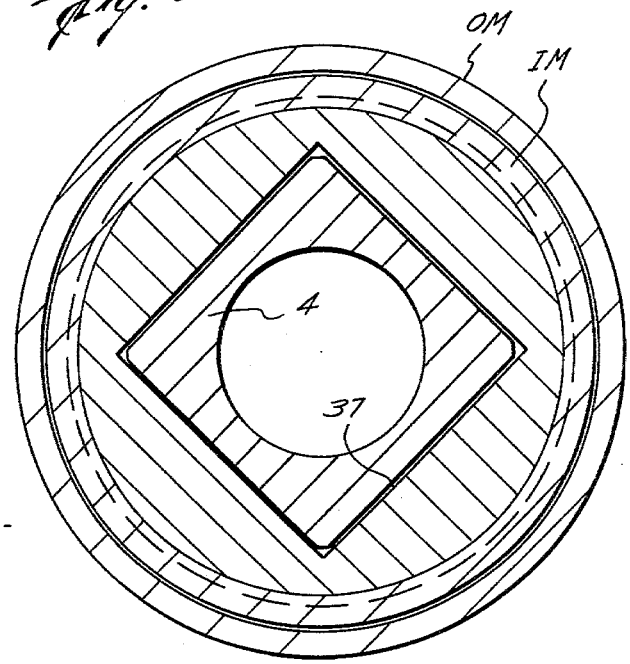
FIG. 7 is a cross-sectional view taken on the line 7—7 of FIG. 4B.

Floating nut 33 is located exteriorly of square exterior portion of the lower section of the tubular support and is slidable therein. The internal bore of nut has a square cross-section fitting the exterior of the support as is illustrated in FIG. 7. The nut is formed with exterior right hand threads 38 which engage similar threads 39 on the bore of the inner tubular member IM. When in connected position (FIG. 4B) the nut 33 abuts upwardly facing annular shoulder 40 provided at the lower portion of the section 4 of the tubular support. Right hand rotation of the tubular support and its angular portion 37 imparts such rotation to the nut 33 and with the inner hanger member IM held against rotation, the nut 33 will be unscrewed from inner tubular member IM; as disconnection occurs, the floating nut 37 slides upwardly on the angular section 37, as illustrated in FIG. 3. A light spring 43 may surround the lower section 4 of the tubular support and is confined between the bearing plate 34 and floating nut 33. During assembly of the apparatus, the spring assists in connecting the nut 33 with the inner tubular member IM by exerting a slight downward force on said nut.

The lower end of the bore of section 4 has internal threads for receiving the valve seat element V. Such valve seat element has an upwardly facing seat 44 which is adapted to be engaged by a ball valve 45 to close the bore of the tubular support against downward flow during setting operations. A ball valve is illustrated in FIG. 4B but any other type valve, such as a plug, can be used; also, the valve may be positioned anywhere below port 29 which conducts pressure fluid to the piston and cylinder assembly PC.

A seal 46 is between the inner hanger member IM and the outer hanger member OM, and seals off between the region above and interior of the top of the inner tubular member IM and the exterior of the interior tubular member IM. Below the seal is bushing 47 which is attached to the exterior of inner tubular member IM and which slidably engages the interior bore of the outer hanger member OM. Lateral port 48 in outer member OM is located below the bushing and provides communication between the region below said bushing with the annulus exterior of outer member OM.

Lower coacting means LC prevent premature setting of gripping means GM by preventing upward movement of expander means EM, inner hanger member IM and running and setting tool RT relative to gripping means GM and outer hanger member OM.

The outer hanger member OM has a collar or sleeve 50 threaded on its lower end and as will be explained, this collar surrounds the inner mandrel and has its lower end 51 adapted to rest upon the upper end of the coupling collar 49, as shown in FIG. 4B. The collar 50 forms part of the gripping means and has connection through vertical straps or connecting bars 52 with a support ring 53 of each of the gripping elements. As shown in FIG. 4C, each gripping element has a vertically extending support arm 54 which is of spring material and which has the gripping slip 55 attached to its upper end. With this arrangement, an upward movement of the outer hanger member relative to the inner hanger member will result in an upward movement of the gripping slips 55 relative to the inner member.

For expanding such gripping slips into a gripping position upon such relative upward movement of the outer hanger member with respect to the lower hanger member, an elongate tubular mandrel 56 is secured to the coupling 49 and extends downwardly a sufficient distance to project below the lower gripping slip assembly. The mandrel 56 has a pair of expander cones 57 secured thereto and associated with one of the gripping slips. Since the mandrel is coupled to the inner hanger member IM, a relative movement of the inner hanger member with respect to the outer hanger member carrying the gripping members will cause said gripping members to move upwardly with respect to the expander cones 57, whereby the slips are moved radially outwardly to engage the wall of a well casing C, as schematically illustrated in FIGS. 2 and 3. Thus the setting of the gripping slips is controlled by the relative movement of the inner and outer hanger members. Although two sets of gripping means or slips are illustrated, it is evident that more or less may be used.

In the operation of the apparatus, the running and setting tool RT is attached to the liner hanger and lowered to the desired depth in the well by use of a string of well pipe.

One of the important features of the present invention resides in preventing the premature setting of the gripping slips of the liner hanger. This is accomplished by relieving the shear pins 22, which connect the outer hanger member to the support of the running tool, from any upward forces which may be applied to the running tool by reason of frictional engagement with the well bore wall during lowering. As clearly shown in FIG. 5, the force-bearing shoulder 20, which is located internally of the outer hanger member, engages the inclined force-bearing beveled area 19 of the support ring 12 which is, in effect, a part of the elongate sleeve 7. At the same time, the inclined force-bearing shoulder 18*a* formed on the exterior of the support TS is engaged by the force-bearing shoulder 17*c* of the collet latch fingers 17. Thus, as the support TS is lowered, the annular surfaces on the support TS and on the support ring 12 engage the respective shoulders on the latch fingers and outer member OM so that any forces tending to move the outer hanger upwardly do not reach the shear pins 22.

When the tool has reached the desired depth in the well, a plug or ball valve 45 is pumped down the well pipe and through the bore of the tool RT or is otherwise suitably placed in sealing engagement with seating surface 44 of valve V thereby closing off the bore of the well pipe string and tool. Pump pressure is applied through well pipe string and the tubular support of the tool RT and is transmitted through port 29 into piston and cylinder assembly PC thereby exerting pressure on the pressure responsive area for piston element 25. The exerted pressure is transmitted through the piston element to frangible shear pin 30 which is severed when a sufficient pump pressure is reached.

As illustrated in FIG. 2, once shear pin 30 is severed, piston element 25 is no longer locked to cylinder 26 and is free to move upward relative to cylinder 26. As piston element 25 moves upward, the interior bore of projection 32 of piston element 25 slides upward along the exterior of enlargement 17*b* of the collet latch elements 17. Once projection 32 is above enlargement 17*b*, enlargement 17*b* is no longer laterally urged into recess 18 and is free to move outwardly away from recess 18 and into the annulus between the exterior of the upper support 2 and the bore of sleeve 31, thereby freeing upper coacting means UC from tubular support TS.

As projection 32 moves upwardly, its upper surface engages the lower surface of the collet 13. Continued upper movement of piston 25 drives collet 13 and the remainder of the attached upper coacting means UC upwardly relative to the tubular support TS.

As piston 25 drives upper coacting means UC upward, the elongated sleeve 7 slides upward along the exterior surface of upper section 2 and the exterior surface of support ring 12 slides upward along the interior bore of outer hanger member OM until upper surface 12*a* of support ring 12 abuts lower surface 21*a* of annular member 21. Since annular connecting member 12 is attached to outer hanger member OM by shear pins 22, the upward force applied by piston 25 through upper coacting means UC is transferred through annular member 21 to shear pins 22 and outer hanger member OM. By staging the strength of shear pins 30 relative to frangible shear pin 22, the pressure exerted by piston 25 that moves upper coacting means UC into abutment with annular member 21 will not be sufficient to sever shear pin 22. Before the pin shears, piston 25 drives annular member 21 and outer hanger member OM upward relative to the tubular support TS and attached inner tubular member IM, to thereby move the gripping means GM into gripping position. This is accomplished because the slips 55 attached to the outer hanger member are pulled upwardly on the expander cones which are attached to the inner hanger member IM.

After the liner hanger is set within the casing (FIG. 2), an increase in pump pressure will sever frangible shear pins 22 releasing the outer hanger member OM from attachment with upper coacting means UC and tubular support TS.

It is evident that in most cases the strengths of the shear pins 22 is greater than that of shear pin 30 and such relationship is subject to variation. For example, shear pin 30 can have a shear rating of 1000 psi and frangible shear pins 22 can have a shear rating of 2000 psi. If less than 1000 psi of pump pressure is exerted within the drill pipe string and the bore of the tool, the connecting or securing means consisting of shear pins 30 will not be severed and piston 25 will not move. Once 1000 psi pump pressure is exerted, shear pins 30 will sever allowing upward movement of piston 25 and subsequent setting of the liner hanger. When disconnection of the liner hanger from the tubular support is desired, a pressure of 2000 psi will sever shear pins 22. The foregoing shear strengths of the shear pins are exemplary only and are not intended to limit the scope of the invention.

Once the plurality of frangible shear pin 22 is severed freeing the outer hanger member OM from the upper coacting means UC and running and setting tool RT, the only connection between said running and setting tool RT and the inner hanger member IM is the second connecting means SC. To release this second connecting means SC, the well pipe string and the tool RT are rotated to the right resulting in a rotational force with minimum torque being transmitted through lower tubular section 4 to floating nut 33 thereby backing floating nut 33 off right hand threads 39 on the interior bore of inner tubular member IM. As floating nut 33 backs off threads 39, said nut 33 moves upwardly along the exterior of lower tubular section 4. As the well pipe string and the running tool are rotated, downward force is imparted through the bearing plate 34 to inner tubular member IM instead of being imparted to floating nut 33. Therefore, the release of second connecting means SC is not impeded by any downward force. By providing threads which are released by right hand rotation, there is no danger of braking out any of the threaded joints in the string or in the tubular support.

As illustrated in FIG. 3, once floating nut 33 is disengaged from inner tubular member IM, running tool RT is free of the apparatus and can be retrieved from the well. As pressure in the well pipe string is reduced, upper coacting means UC descends in the annulus between support TS and outer hanger member OM until the internal annular shoulder of collar 14 abuts upwardly facing shoulder 16 of upper section 2 thereby preventing any further downward movement of upper coacting means UC in the annulus. Similarly, after pressure reduction in the well pipe string, piston 25 descends in the annulus until a downwardly facing shoulder 25*a* located on the exterior of piston 25 abuts upwardly facing shoulder of cylinder 26.

It is noted that when the running and setting tool RT and the well pipe string are pulled out of the well, the upper coacting means UC, tubular support TS, piston and cylinder assembly PC, and parts of first connecting means FC and second connecting means SC are all retrieved and it is not necessary to leave these parts in the well.

Any standard liner hanger that is attachable to the running tool RT by nut 33 can be set by running tool RT provided the liner hanger has a shoulder which abuts shoulder 19 of upper coacting means UC during presetting operations.

What is claimed is:

1. A running and setting tool for a well liner hanger wherein the hanger comprises a pair of movable tubular members and gripping means actuated by relative movement of said members, said tool including, a tubular support, means connecting the support to both of the movable tubular members of the liner hanger and being selectively releasable, a piston and cylinder assembly mounted on said support, means for conducting pressure fluid to said piston and cylinder assembly to actuate said assembly upon application of a predetermined pressure to said assembly whereby continued subsequent pressure application to the assembly moves the piston and cylinder relative to each other, means for transmitting the forces developed by the actuation of the piston and cylinder assembly to the tubular members of the liner hanger so that actuation of the piston and cylinder assembly moves said tubular members relative to each other to thereby set the gripping means of the hanger, and coacting means on the tubular support of the tool and on the liner hanger for preventing premature actuation of the gripping means of said hanger as the tool and hanger are moved within the well bore, said coacting means preventing any relative movement between the tubular members prior to actuation of the piston and cylinder assembly by pressure fluid.

2. A running and setting tool for a well liner hanger as set forth in claim 1, wherein the coacting means on said support comprises downwardly facing force-bearing abutments, and said coacting means on one of the tubular members of the liner hanger comprising upwardly facing complementary force-bearing abutments engaged with the abutments of the support to limit downward movement of said support relative to said tubular member during lowering of the tool and hanger within the well.

3. A running and setting tool for a well liner hanger as set forth in claim 1, wherein the coacting means on said support comprises downwardly facing force-bearing abutments, said coacting means on one of the tubular members of the liner hanger comprising upwardly facing complementary force-bearing abutments engaged with the abutments of the support to limit downward movement of said support relative to said tubular member during lowering of the tool and hanger within the well, and said coacting means also including engaging complementary force-bearing abutments on the two tubular members of the hanger to restrict premature relative movement of said members relative to each other during upward movement of the tool and hanger within the well.

4. A running and setting tool as set forth in claim 1, wherein the means connecting the support to one movable tubular member of the liner hanger is a frangible means, and the means for connecting the support to the other said tubular member of said liner hanger is a threaded connection.

5. A running and setting tool for a well liner hanger wherein the hanger comprises a pair of movable tubular members and gripping means actuated by relative movement of said members, said tool including, a tubular support, means connecting the support to both of the movable tubular members of the liner hanger and being selectively releasable, a piston and cylinder assembly mounted on said support, means for preventing operation of said piston and cylinder assembly, means for releasing said piston and cylinder assembly for operation upon application of a predetermined pressure to said assembly whereby pressure application to said piston and cylinder assembly after the release of said means moves the piston and cylinder relative to each other, means for transmitting the forces developed by the actuation of the piston and cylinder assembly to the tubular members of the liner hanger so that actuation of the piston and cylinder assembly moves said tubular members relative to each other to thereby set the gripping means of the hanger, and coacting means on the tubular support of the tool and on the liner hanger for preventing premature actuation of the gripping means of said hanger as the tool and hanger are moved within the well bore, said coacting means preventing any relative movement between the tubular members prior to activation of the piston and cylinder assembly by pressure fluid.

6. A running and setting tool for a well liner hanger as set forth in claim 5, wherein the means for preventing operation of said piston and cylinder assembly is a securing means which is selectively releasable in accordance with the pressure applied to said assembly.

7. A running and setting tool for a well liner hanger as set forth in claim 5, wherein the means for preventing operation of said piston and cylinder assembly is a frangible connecting pin which secures the piston and cylinder to each other.

8. A running and setting tool for a well liner hanger as set forth in claim 5, wherein the means connecting the support to one movable tubular member of the liner hanger is a frangible means, and the means for connecting the support to the other said tubular member of said liner hanger is a threaded connection.

9. A running and setting tool for a well liner hanger as set forth in claim 5, wherein the means connecting the support to one movable tubular member of the liner hanger is a frangible means, and the means for connecting the support to the other tubular member of said liner hanger is a threaded connection which is disposed between the tubular support and said movable tubular member, said threaded connection being releasable by a right-hand rotation of the support with respect to the member.

10. A running and setting tool for a well liner hanger as set forth in claim 9, wherein the coacting means on said support comprises a downwardly facing force-bearing abutment, and said coacting means on one of the tubular members of the liner hanger comprising an upwardly facing complementary force-bearing abutment engaged with the abutment of the support to limit downward movement of said support relative to said tubular member during lowering of the tool and hanger within the well.

11. A running and setting tool for a well liner hanger as set forth in claim 9, wherein the coacting means on said support comprises downwardly facing force-bearing abutments, said coacting means on one of the tubular members of the liner hanger comprising an upwardly facing complementary force bearing abutment engaged with the abutment of the support to limit downward movement of said support relative to said tubular member during lowering of the tool and hanger within the well, and said coacting means also including engaging complementary force-bearing abutments on the two tubular members of the hanger to restrict premature relative movement of said member relative to each other during upward movement of the tool and hanger within the well.

12. A running and setting tool for a well liner hanger wherein the hanger comprises a pair of movable tubular members and gripping means actuated by relative movement of said members, said tool including, a tubular support, means connecting the support to each of the pair of movable tubular members of the liner hanger and being selectively releasable, a piston and cylinder assembly mounted on said support, means for preventing operation of said piston and cylinder assembly, means for releasing said piston and cylinder assembly for operation upon application of a predetermined pressure to said assembly whereby subsequent pressure application to said piston and cylinder assembly moves the piston and cylinder relative to each other, means for transmitting the forces developed by the actuation of the piston and cylinder assembly to the tubular members of the liner hanger so that actuation of the piston and cylinder assembly moves said tubular members relative to each other to thereby set the gripping means of the hanger, means for thereafter utilizing said forces to effect a release of the connecting means between the support and one of the tubular members of the liner hanger, coacting means on the support and the liner hanger for preventing premature release of the connecting means between said support and hanger as the tool and hanger are moved within the well bore, and said connecting means preventing retrieval of the running and setting tool until the connecting means between the support and both of the tubular members of the liner hanger is released.

13. A running and setting tool for a well liner hanger as set forth in claim 12, wherein the means connecting the tubular support of the tool to one of the tubular members of the liner hanger is a frangible means, and the means connecting the support to the other of the tubular members of the liner hanger is a threaded connection which is releasable after the liner is set by a right-hand rotation of the support relative to said tubular member.

14. A running and setting tool for a well liner hanger wherein the hanger comprises a pair of movable tubular concentric members and gripping means actuated by relative movement of said members, said tool including, a tubular support, means connecting the support to each of the pair of movable tubular members of the liner hanger and being selectively releasable, a piston and cylinder assembly mounted on said support, means for supplying pressure fluid to the assembly through the tubular support, means securing said piston and cylinder to each other to prevent operation of the assembly, means for releasing said piston and cylinder assembly for operation upon application of a predetermined pressure to said assembly so that subsequent application of pressure to said piston and cylinder assembly moves the piston and cylinder relative to each other, means for transmitting the forces developed by the actuation of the piston and cylinder assembly to the tubular members of the liner hanger so that actuation of said piston and cylinder assembly moves said tubular members relative to each other to thereby set the gripping means of the liner hanger, means to thereafter transmit the movement of one of the piston or cylinder of the assembly to one of the tubular members of the liner hanger to effect a release of the connecting means between the support and one of the tubular members of said hanger, means to disconnect the support from the other of said tubular members to permit removal of the running and setting tool, and coacting means on the support and on the liner hanger for preventing premature actuation of the gripping means of the liner hanger as the tool and hanger are moved within the well bore.

15. A running and setting tool for a well liner hanger as set forth in claim 14, wherein said coacting means comprises force bearing surfaces on the tubular support and a support shoulder within the bore of one of the tubular members of the liner hanger to prevent relative movement of the support and tubular member in one direction, and engaging surfaces on the tubular members of the liner hanger to prevent relative movement in the opposite direction.

16. A running and setting tool for a well liner hanger wherein the hanger comprises an outer tubular member and an inner tubular member movable with respect to said outer member and gripping means actuated by relative movement of said members, said tool including, a tubular support, a threaded connection connecting said support to the inner tubular member, frangible means connecting said support to the outer tubular member, a piston and cylinder assembly mounted between the tubular support and the outer body, means for supplying pressure fluid to said assembly through the tubular support, means for preventing operation of the piston and cylinder assembly prior to a tool setting operation, means for releasing said preventing means upon application of a predetermined pressure to said assembly whereby subsequent pressure application to said assembly results in actuation thereof to move the piston and cylinder relative to each other, means for transmitting the relative motion of the piston and cylinder to the outer tubular member and to the inner tubular member to effect relative movement of said body and said member, gripping means for supporting the hanger within a well bore and actuated by the relative movement of said body and said member, and coacting means on the support and the liner hanger for preventing premature actuation of the gripping means of said hanger as said tool and hanger are moved within a well bore.

* * * * *